US006247524B1

(12) United States Patent
Slasky

(10) Patent No.: US 6,247,524 B1
(45) Date of Patent: Jun. 19, 2001

(54) THERMAL SWITCHES AND METHODS FOR IMPROVING THEIR PERFORMANCE

(75) Inventor: Dan Slasky, Rehovot (IL)

(73) Assignee: ELOP Electro-Optics Industries Ltd., Rehovot (IL)

( * ) Notice: Subject to any disclaimer, the term of this patent is extended or adjusted under 35 U.S.C. 154(b) by 0 days.

(21) Appl. No.: 09/252,481

(22) Filed: Feb. 18, 1999

(30) Foreign Application Priority Data

Mar. 4, 1998 (IL) ..... 123546

(51) Int. Cl.[7] ..... F28F 27/00
(52) U.S. Cl. ..... 165/96; 165/276
(58) Field of Search ..... 165/96, DIG. 515, 165/276, 277, 104.26

(56) References Cited

U.S. PATENT DOCUMENTS 3,787,110 * 1/1974 Berreman et al. ..... 349/110
3,995,939 * 12/1976 Borel et al. ..... 345/939
4,515,206 * 5/1985 Carr ..... 165/96
4,556,287 * 12/1985 Funada et al. ..... 349/165
4,958,916 * 9/1990 Clark et al. ..... 349/37
5,222,548 * 6/1993 Biggers et al. ..... 165/96
5,465,782 * 11/1995 Sun et al. ..... 165/104.26
6,130,738 * 10/2000 Hatano et al. ..... 349/156

* cited by examiner

*Primary Examiner*—Ira S. Lazarus
*Assistant Examiner*—Tho Van Duong
(74) *Attorney, Agent, or Firm*—Connolly Bove Lodge & Hutz

(57) ABSTRACT

The invention provides a thermal switch, including a frame made of electrically insulating material, defining the perimeter of a cell fillable with liquid crystal (LC); first and second plate-shaped electrodes, each having an inside surface and an outside surface and being attached along the periphery of the inside surface on opposite sides of the frame, defining surfaces of the cell; first and second covers made of electrically insulating material, each attached to the outside surface of one electrode, the inside surface of at least a portion of each of the electrodes being treated to obtain anchoring of the orientation of LC molecules in a direction parallel to the plane of the electrode, resulting in improved performance of the switch.

11 Claims, 2 Drawing Sheets

THERMAL SWITCHES AND METHODS FOR IMPROVING THEIR PERFORMANCE

FIELD OF THE INVENTION

The present invention relates to thermal switches and methods for improving their performance. The thermal switches of the present invention are particularly useful for diode-pumped lasers.

BACKGROUND OF THE INVENTION

A diode-pumped, solid state laser has a higher operating efficiency than a flashlamp-pumped, solid state laser, due to the good spectral matching of the light emitted by a diode to the absorptive region of the solid state laser. The wavelength emitted by the laser diode is extremely temperature-sensitive and therefore requires a temperature control mechanism to stabilize the diode at a set operating temperature. The control mechanism can be achieved by use of thermoelectric coolers, liquid cold plates, or air-cooled heat exchangers. A dichotomy exists as to the function of the heat transfer mechanism. At high ambient temperatures, the heat transfer mechanism of the system must enable low thermal resistance from the diode to the ambient in order to ensure that the temperature of the diode does not rise above the setpoint temperature. At low ambient temperatures in the "stand-by" mode, the diode laser is heated in order to stabilize the laser at the setpoint temperature. Therefore, at low temperatures, the thermal resistance to the ambient must be large, in order to decrease heat losses to the environment. This dichotomy is the reason for the development of a thermal switch, or thermal "clutch," which enables a low thermal resistance to the ambient at high ambient temperatures and a high thermal resistance at low ambient temperatures.

U.S. Pat. No. 4,515,206 (Carr) describes a generalized heat switch on the basis of a liquid crystal (LC) cell, with no particular application stated. The Carr design of the LC cell includes LC material encapsulated within a Teflon cell, with electrodes placed at both ends of the cell. High voltage (DC or AC) applied to the cell induces electrohydrodynamic (EHD) motion, and thus increases the effective thermal conductivity of the LC within the cell.

EHD motion is formed due to a dipole, or moment, applied to LC molecules when they are placed within an electric field. In order for there to be a moment on the molecules, they have to be initially oriented in a plane parallel to the electrode surface. It is stated in the Carr patent that molecular alignment of an LC is achieved by the wall effect of the electrode, which causes the molecules to align in the parallel direction. In order to ensure that the molecules will be correctly aligned throughout the bulk of this prior art device, it is suggested to apply a magnetic field in the direction parallel to the plane of the electrodes. Subsequent application of an electric field will result in EHD motion.

U.S. Pat. No. 5,222,548 (Biggers et al.) describes a heat valve having a concept similar to that of Carr, with a number of changes. The heat valve of the Biggers patent is used in divers' wetsuits in order to regulate the heat transfer from the diver to the water to avoid hypo/hyperthermia. The Biggers concept is based on applied AC voltage alone, with an optimum voltage and frequency needed for each cell geometry, such as cell cross-sectional area, the distance between electrodes, etc.

The Biggers design uses AC voltages to induce EHD motion. Use of AC voltages has its advantages, but also has disadvantages. An LC cell based on AC voltage design requires the optimization of frequency and voltage for each cell geometry, a procedure which is timely and costly. The use of AC voltages results in EMI/RFI noise, which can interfere with the diode laser operation. In addition, the power supplies for AC voltages at varied frequencies are more costly and cumbersome than DC power supplies.

Other types of heat switches are known, but all suffer from various disadvantages, including moving parts, high power consumption, large volume and gravity-dependence.

DISCLOSURE OF THE INVENTION

It is therefore a broad object of the present invention to ameliorate the deficiencies of the above-described devices and to provide an LC-based thermal switch utilizing the unique electrical and thermal properties of liquid crystals in order to obtain a heat switch.

It is a further object of the present invention to provide a thermal switch which contains no moving parts, has low power consumption, is of small volume and is not gravity-dependent.

It is a still further object of the present invention to provide methods for forming a thermal switch of improved performance.

In accordance with the present invention, there is therefore provided a thermal switch comprising a frame made of electrically insulating material, defining the perimeter of a cell fillable with liquid crystal (LC); first and second plate-shaped electrodes, each having an inside surface and an outside surface and being attached along the periphery of said inside surface on opposite sides of said frame, defining surfaces of said cell; first and second covers made of electrically insulating material, each attached to the outside surface of one electrode, the inside surface of at least a portion of each of said electrodes being treated to obtain anchoring of the orientation of LC molecules in a direction parallel to the plane of said electrode, resulting in improved performance of said switch.

The invention further provides a method for orienting LC molecules in a thermal switch including an LC cell interposed between two spaced-apart electrodes and enclosed in a housing, said method comprising treating at least one inner surface of said electrodes for anchoring the orientation of LC molecules in a direction parallel to the plane of said electrodes.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is an exploded view of a first embodiment of an LC thermal switch according to the present invention;

FIG. 2 is a cross-sectional view of the thermal switch of FIG. 1;

FIG. 3 is a plan view illustrating surface treatment of an electrode;

FIG. 4 is an exploded view of a second embodiment of an LC thermal switch according to the invention;

FIG. 5 is a cross-sectional view of the thermal switch of FIG. 4, and

FIG. 6 is an isometric view of a partition of the embodiment of FIGS. 4 and 5, illustrating surface treatment of a partition.

DETAILED DESCRIPTION OF PREFERRED EMBODIMENTS

Figure 1:
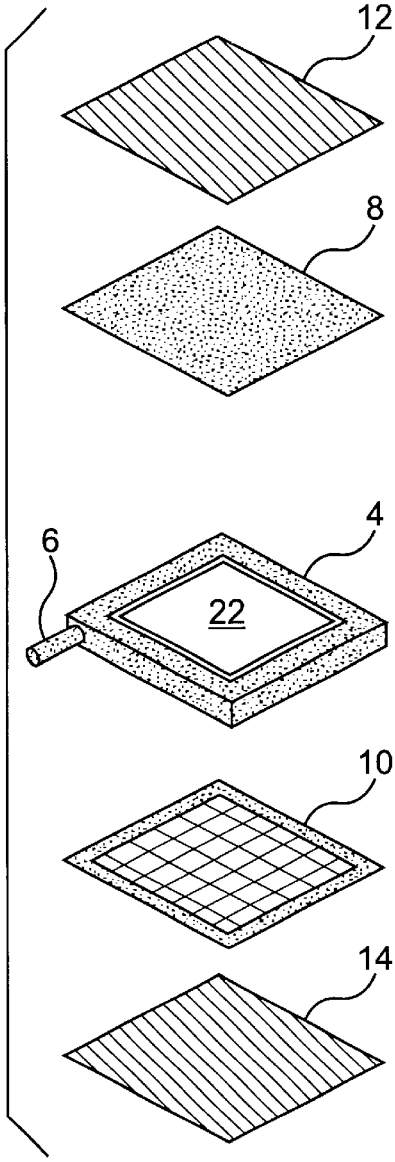
Figure 2:
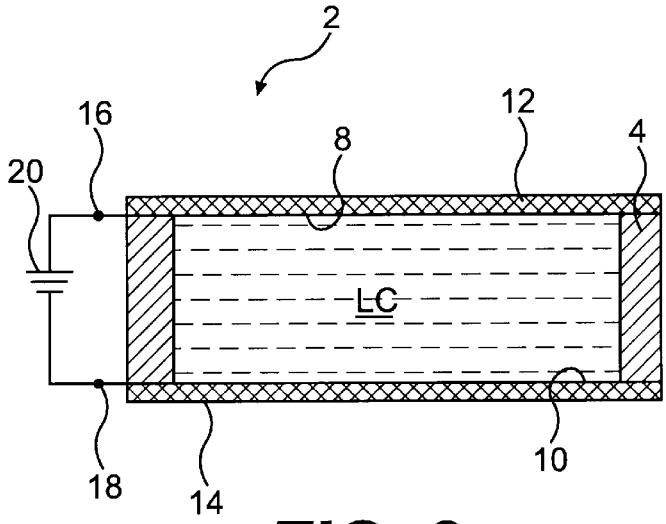

Referring to FIGS. 1 and 2, there is shown a first embodiment according to the present invention of a thermal switch 2, composed of a cell frame 4 made of plastic or of any other thermally and electrically insulating material able to withstand environmental and shock requirements. The cell frame 4 is advantageously fitted with an LC filling tube 6 which can also serve as a reservoir for LC volume compensation. Top and bottom plate-shaped electrodes 8 and 10, made of metal or metallic coating on a ceramic substrate, contact the frame on two of its opposite sides. The electrodes 8 and 10 are respectively covered by a top cover 12 and a bottom cover 14, which covers are made of ceramic, sapphire, or any other electrically insulating material having high thermal conductivity and a minimum of 10 kV/mm voltage breakdown. Inside the thus-constructed cell there is introduced LC material such as MBBA, N4, or any other nematic-type liquid crystal meeting the requirements of the applicable temperature range in the nematic state. The cell can be sealed by the use of RTV or another applicable sealant, of suitable thickness capable of withstanding internal forces due to temperature changes. Each of the electrodes 8 and 10 may be provided with terminals 16, 18 to be connected to a DC source 20, or otherwise connectable in use to such a source.

Figure 3:
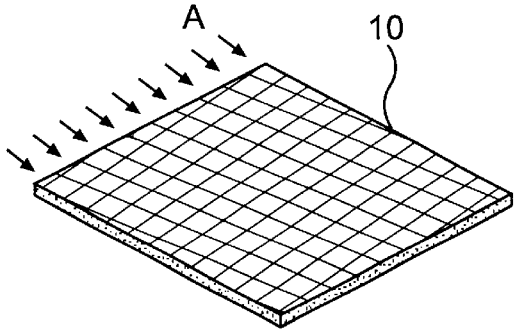

The orientation of the LC molecules in the cell is an important factor in achieving optimal thermal performance of the cell. In accordance with the first embodiment of the invention, and with reference also to FIG. 3, such an orientation is achieved by surface-treating the electrodes 8 and 10 in order to obtain strong anchoring of the molecules in a direction parallel to the electrode plane. Strong anchoring ensures that the molecules near the electrode surface are in fact correctly oriented. The arrows A indicate the direction of orientation. Such anchoring may be achieved either by creating micro-grooves in the electrode surface by rubbing it with a polishing cloth soaked in a suitable paste, such as diamond paste, or by vapor depositing of suitable materials such as Cr, Pt, Al, Au and SiO, in films of less than 10 nm thick.

Figure 4:
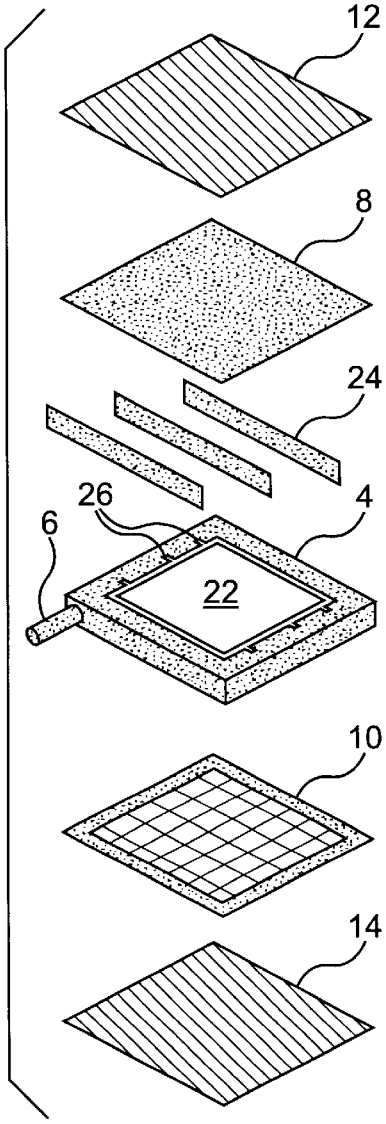
Figure 5:
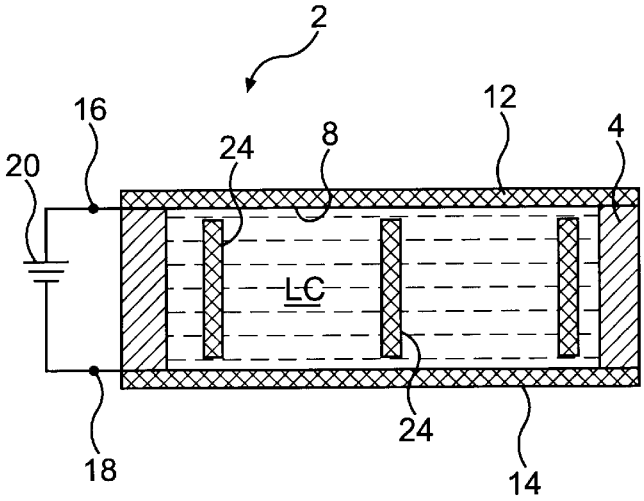
Figure 6:
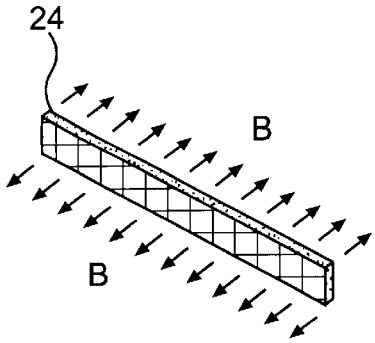

Turning now to FIGS. 4 to 6, there is illustrated a second embodiment of the present invention, in which, inside the void 22 defined by the frame 4, there are interposed internal partitions 24, which may be held in position by means of recesses 26 made in the opposite surfaces of the inner periphery of frame 4. The partitions 24 may be constructed of glass or any other insulating material, and are surface treated to achieve molecular orientation in a direction perpendicular to the wall surface. The thickness and number of partitions are dependent on the cell geometry. The partition height should be less than the distance between the electrodes, due to the fact that the surface of the electrodes and the partitions orients the LC molecules in different directions.

While the first embodiment of the present invention will ensure molecular alignment in the desired orientation for a thin film of LC close to the electrode surface, the second embodiment of the invention will result in the correct orientation of the majority of the LC bulk. The electrode surfaces can therefore be surface-treated as in the first embodiment, to ensure molecular orientation close to the electrode surface in the direction parallel to the electrode plane. In addition, the partitions constructed of glass or any other insulating material are placed within the cell. The surfaces of the partitions are treated in order to achieve molecular alignment in the direction perpendicular thereto, as indicated by the arrow B in FIG. 6. This ensures that molecular alignment of the bulk of the LC is in the direction parallel to the plane of the electrodes.

Alignment of the molecules perpendicular to the partition surfaces may be achieved by chemically treating said surfaces with polyamides or with certain lipids such as lecithin or dimethylpolysiloxane, or by applying chromosulphuric acid on the surfaces of the partitions.

A thermal switch according to the present invention is utilizable as a temperature control device in diode-pumped laser modules, based on an LC cell wherein a DC electric field induces EHD motion, thus facilitating heat flow from one end of the cell to the other. The use of DC voltages is advantageous, due to the compactness of a DC power supply compared to AC power supplies, and the fact that no frequency optimization is required for each cell design. In addition, DC operation has less EMI/RFI noise than AC operation, providing a superior thermal switch.

While in the preferred embodiments illustrated herein, the switch is generally prismatic, it is, of course, possible to form a disc-shaped switch wherein the cell frame is an annulus and the electrodes and covers are discs.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A thermal switch, comprising:

a frame made of electrically insulating material, defining the perimeter of a cell;

first and second plate-shaped electrodes, each having an inside surface and an outside surface and being attached along the periphery of said inside surface on opposite sides of said frame, forming surfaces of said cell and defining, with said frame, a void fillable with a volume of liquid crystal;

first and second covers made of electrically insulating material, each attached to the outside surface of one electrode;

the inside surface of at least a portion of each of said electrodes being treated to obtain anchoring of the orientation of liquid crystal molecules in a direction parallel to the plane of said electrode; and one or more spaced-apart partitions extending inside said cell within said frame.

2. The thermal switch as claimed in claim 1, wherein said inside surfaces of the electrodes are made with micro-grooves.

3. The thermal switch as claimed in claim 1, wherein said inside surfaces of the electrods are vapor-deposited with selected materials.

4. The thermal switch as claimed in claim 3, wherein said materials are selected from the group consisting of Cr, Pt, Al, Au and SiO.

5. A thermal switch as claimed in claim 1, wherein at least one of the opposite surfaces of each said partition is treated to obtain alignment of the liquid crystal molecules in a direction perpendicular to the planes of said partitions.

6. The thermal switch as claimed in claim 1, wherein the surfaces of said partitions are treated with polyamides, lipids or dimethylpolysiloxane.

7. The thermal switch as claimed in claim 6, wherein said lipids are lecithin.

8. The thermal switch as claimed in claim 1, wherein the surfaces of said partitions are treated by the application thereon of chromosulphuric acid.

9. The thermal switch as claimed in claim 1, further comprising a conduit passing through said frame and communicating with said cell for filling said cell with liquid crystal.

10. The thermal switch as claimed in claim 1, further comprising a reservoir communicating with said cell, forming a liquid crystal volume compensator.

11. The thermal switch as claimed in claim 1, further comprising terminal means connected to said electrodes for connection to a DC power source.

* * * * *